US009695820B2

(12) United States Patent
Lee et al.

(10) Patent No.: US 9,695,820 B2
(45) Date of Patent: Jul. 4, 2017

(54) COMPRESSOR AND CONTROL METHOD THEREOF

(71) Applicant: SAMSUNG ELECTRONICS CO., LTD., Suwon (KR)

(72) Inventors: Joon Hwan Lee, Uiwang-si (KR); Kyoung Rock Kim, Suwon-si (KR); Byoung Guk Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 417 days.

(21) Appl. No.: 13/864,697

(22) Filed: Apr. 17, 2013

(65) Prior Publication Data

US 2014/0044562 A1 Feb. 13, 2014

(30) Foreign Application Priority Data

Aug. 9, 2012 (KR) ..... 10-2012-0087081

(51) Int. Cl.

| | |
|---|---|
| ***F04C 28/06*** | (2006.01) |
| ***F04C 23/02*** | (2006.01) |
| ***F04C 28/08*** | (2006.01) |
| ***F04C 28/28*** | (2006.01) |
| ***F04C 29/04*** | (2006.01) |
| *F04C 23/00* | (2006.01) |

(52) U.S. Cl.

CPC ..... *F04C 23/02* (2013.01); *F04C 28/08* (2013.01); *F04C 28/28* (2013.01); *F04C 29/04* (2013.01); *F04C 23/008* (2013.01); *F04C 28/06* (2013.01); *F04C 2240/81* (2013.01); *F04C 2270/195* (2013.01)

(58) Field of Classification Search

CPC ..... F04B 17/03; F04B 35/04; F04B 19/06; F04B 49/065; F04C 15/0096; F04C 2270/035; F04C 28/08; F04C 28/28; F04C 2270/07

See application file for complete search history.

(56) References Cited

U.S. PATENT DOCUMENTS

| | | | | |
|---|---|---|---|---|
| 5,459,386 | A * | 10/1995 | Okachi | H02P 21/09 318/721 |
| 2005/0247073 | A1* | 11/2005 | Hikawa | F04B 49/065 62/228.1 |
| 2009/0090118 | A1* | 4/2009 | Pham et al. | 62/228.5 |
| 2009/0120112 | A1* | 5/2009 | Nakamura et al. | 62/228.1 |
| 2011/0070100 | A1* | 3/2011 | McSweeney et al. | 417/53 |

FOREIGN PATENT DOCUMENTS

| | | | |
|---|---|---|---|
| JP | 07180933 | A * | 7/1995 |
| JP | 2008064447 | A * | 3/2008 |

* cited by examiner

*Primary Examiner* — Charles Freay
*Assistant Examiner* — Thomas Cash
(74) *Attorney, Agent, or Firm* — Staas & Halsey LLP

(57) ABSTRACT

A compressor capable of reducing oil foaming and reducing the waiting time taken until the heating of the compressor is completed, and a method of controlling the same, the method of controlling a compressor including sensing temperature of the oil in the compressor, if the temperature of the oil is below a reference temperature, performing a loss operation, in which an amount of heat radiation of the motor part is increased, while operating the motor part at a low speed, and if the temperature of the oil increases to be equal to or higher then reference temperature, performing an efficiency operation by converting an operation of the motor to a normal operation.

14 Claims, 13 Drawing Sheets

FIG. 7A - Related Art
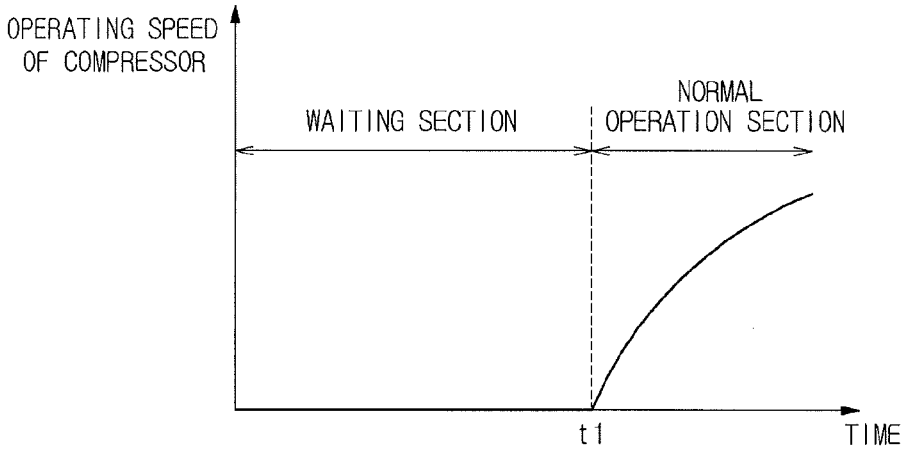

COMPRESSOR AND CONTROL METHOD THEREOF

CROSS-REFERENCE TO RELATED APPLICATIONS

This application claims the benefit of Korean Patent Application No. 10-2012-0087081, filed on Aug. 9, 2012 in the Korean Intellectual Property Office, the disclosure of which is incorporated herein by reference.

BACKGROUND

1. Field

Embodiments of the present disclosure relate to a compressor and a control method thereof, and more particularly, to a compressor capable of reducing oil foaming occurring when the compressor is controlled, while reducing the waiting time taken until the heating of the compressor is completed, and a control method thereof.

2. Description of the Related Art

A compressor represents a mechanical apparatus designed to increase the pressure by compressing refrigerant of a gas state. The compressor includes a casing configured to seal the refrigerant and the oil while forming an accommodation space therein, a compressing part provided at an inside the casing to compress the refrigerant, and a motor part provided at an inside the casing to provide the compression part with a driving force.

If the compressor is placed at a low temperature for a long period of time while in a power-off state, the temperature of oil stored in the casing is lowered. If the temperature of oil is lowered, the refrigerant dissolves in the oil. In a state of the refrigerant dissolving in the oil, if the compressor is driven at a high speed, the pressure and the temperature at an inside of the casing are rapidly changed. As a result, the refrigerant dissolving in the oil is rapidly separated from the oil, and an oil foaming occurs, thereby causing the oil in a foam state to be discharged all together through an outlet port. If the oil in a foam state is discharged all together through the discharge port of the compressor, the oil is scarce within the casing of the compressor until the oil is collected by passing through a refrigeration cycle. Such a lack of oil causes a bearing part of the compressor to be worn away.

Accordingly, in order to prevent the oil foaming, the casing of the compressor needs to be heated to increase the temperature of the oil to a predetermined degree, so that the oil is separated from the refrigerant. In order to heat the casing of the compressor, several types of methods may be used. In a first example, which is referred to as a crank case heater (CCH) method, a heater is installed at an outside the compressor, and in a stop state of the compressor, the casing of the compressor is heated by use of the heater. In a second example, which is referred to as a wiring heating method, in a stop state of the compressor, a predetermined electric current flows through a wiring of the motor part, and the casing of the compressor is heated by use of the heat generated from the wiring due to the flow of the electric current.

However, the CCH method and the wiring heating method take a long waiting time until the heating is completed. In addition, in the case of using the wiring heating method in a scroll compressor having the compressor part at the upper side thereof, the oil of the compression part flows down, thereby causing a wrap, at which a stationary scroll makes contact with an orbiting scroll, to be worn away.

SUMMARY

Therefore, it is an aspect of the present disclosure to provide a compressor capable of reducing the oil foaming while reducing the waiting time taken until the heating of the compressor is completed, and a control method thereof.

Additional aspects of the disclosure will be set forth in part in the description which follows and, in part, will be apparent from the description, or may be learned by practice of the disclosure.

In accordance with one aspect of the present disclosure, a method of controlling a compressor including a casing configured to accommodate refrigerant and oil while forming an accommodation space therein, a compressor part to compress refrigerant while being installed at an inside of the casing, a motor part installed at an inside of the casing to provide the compressing part with a driving force, and a sensor part having at least one temperature sensor to, if an operation command is input, sense temperature of the oil, if the temperature of the oil is below a reference temperature, perform a loss operation, in which an amount of heat radiation of the motor part is increased, while operating the motor part at a low speed, and if the temperature of the oil increases to be equal to or higher than the reference temperature, perform an efficiency operation by converting an operation of the motor to a normal operation.

The at least one temperature sensor may include a first temperature sensor and a second temperature sensor. The first temperature sensor may be configured to sense temperature of the oil while being penetratively installed from an outside the casing to an inside the casing so as to make contact with the oil. The second temperature sensor may be configured to sense temperature of the refrigerant being discharged from the casing while being installed at an outlet port of the casing.

The at least one temperature sensor may include a first temperature sensor and a second temperature sensor. The first temperature sensor may be configured to sense temperature of the casing while being installed at an outside the casing. The second temperature sensor may be configured to sense temperature of refrigerant being discharged from the casing while being installed at an outlet side of the casing.

The sensing of the temperature of the oil may include, by the first temperature sensor, sensing temperature of the casing, compensating the sensed temperature of the casing to a value approximate to actual temperature of the oil.

The performing of the loss operation may include, if a present current command is within a current limit circle that represents a range of a magnetic flux current command and a torque current command that are controllable by a maximum stator current that is set to the motor part, supplying the motor part with a new current command having a value larger than the present current command.

When the current limit circle, a load curve and a maximum torque curve per unit current are represented on d and q axes current coordinate plane, the new current command may include a magnetic flux current command and a torque current command of a point satisfying the load curve among current values belonging to the current limit circle.

The reference temperature may include a first reference temperature and a second reference temperature. The loss operation may be performed if the temperature of the oil is below the first reference temperature. The efficiency operation may be performed if the temperature of the oil is equal to or higher than the second reference temperature and a discharge superheat is equal to or higher than a third reference temperature.

The first reference temperature may be equal to the second reference temperature.

The first reference temperature may be different from the second reference temperature.

In accordance with another embodiment of the present disclosure, a compressor includes a casing, a compression part, a motor part, a sensor part, a control part. The casing may be configured to accommodate refrigerant and oil while forming an accommodation space therein. The compression part may be configured to compress the refrigerant while being installed at an inside of the casing. The motor part may be configured to provide the compressor part with a driving force while being installed at an inside of the casing. The sensor part may include at least one temperature sensor. The control part may be configured to sense temperature of oil if an operation command is input, perform a loss operation in which an amount of heat radiation of the motor part is increased while operating the motor part at a low speed if the temperature of the oil is below a reference temperature, and perform an efficiency operation by converting an operation of the motor part to a normal operation if the temperature of the oil is increased to be equal to or higher than the reference temperature.

The at least one temperature sensor may include a first temperature sensor and a second temperature sensor. The first temperature sensor may be configured to sense temperature of the oil while being penetratively installed from an outside of the casing to an inside of the casing so as to make contact with the oil. The second temperature sensor may be configured to sense temperature of the refrigerant being discharged from the casing while being installed at an outlet port of the casing.

The at least one temperature sensor may include a first temperature sensor and a second temperature sensor. The first temperature sensor may be configured to sense temperature of the casing while being installed at an outside of the casing. The second temperature sensor may be configured to sense temperature of refrigerant being discharged from the casing while being installed at the outlet port of the casing.

The compressor may further include a compensation part configured to compensate the temperature of the casing sensed by the first temperature sensor to a value approximate to actual temperature of the oil.

If a present current command is within a current limit circle that represents a range of a magnetic flux current command and a torque current command that are controllable by a maximum stator current that is set to the motor part, the control part may provide the motor part with a new current command having a value larger than the present current command.

When the current limit circle, a load curve and a maximum torque curve per unit current are represented on a d-q axes current coordinate plane, the new current command may include a magnetic flux current command and a torque current command of a point satisfying the load curve among current values belonging to the current limit circle.

The reference temperature may include a first reference temperature and a second reference temperature. The controller may perform the loss operation if the temperature of the oil is below the first reference temperature, and the controller may perform the efficiency operation if the temperature of the oil is equal to or higher than the second reference temperature and a discharge superheat is equal to or higher than a third reference temperature.

The first reference temperature may be equal to the second reference temperature.

The first reference temperature may be different from the second reference temperature.

In accordance with another aspect of the present disclosure, a method of controlling a compressor including a casing configured forming an accommodation space therein to accommodate refrigerant and oil, a compressor part to compress refrigerant while being installed at an inside the casing, a motor part installed at an inside the casing to provide the compressing part with a driving force, and a sensor part having at least one temperature sensor includes determining, based on temperature of the oil, whether a low speed operation of the motor part is required, and performing the low speed operation of the motor part if determined that the low speed operation of the motor part is required, and then performing a high speed operation of the motor part. During the performing of the low speed operation of the motor part, a loss operation, in which an amount of heat radiation of the motor part is increased, may be performed by increasing an electric current being supplied to the motor part. During the performing of the high speed operation of the motor part, an efficiency operation in which an operating efficiency of the motor part is enhanced may be performed.

The method may further include, by the sensor part, which is installed at an outside of the casing, sensing the temperature of the casing, and compensating the sensed temperature of the casing to a value approximate to actual temperature of the oil.

The method may further include, by the sensor part, which is penetratively installed from an outside of the casing to an inside of the casing so as to make contact with the oil, sensing temperature of the oil.

The method may further include predicting the temperature of oil based on at least one of a time period during which the motor part stops and ambient temperature.

The determining of whether the low speed operation of the motor part is required may include, if the temperature of the oil is below a first reference temperature, determining that the low speed operation of the motor part is required.

When a current limit circle, a load curve and a maximum torque curve per unit current with respect to the motor part are represented on a d and q axes current coordinate plane, the loss operation may represent providing the motor part with a magnetic flux current command and a torque current command of a point satisfying the load curve among current values belonging to the current limit circle.

In accordance with another aspect of the present disclosure, a compressor includes a casing, a compression part, a motor part, a sensor part, and a control part. The casing may be configured to accommodate refrigerant and oil while forming an accommodation space therein. The compression part may be configured to compress the refrigerant while being installed at an inside of the casing. The motor part may be configured to provide the compressor part with a driving force while being installed at an inside of the casing. The sensor part may be configured to sense temperature of the oil. The control part, based on the temperature of the oil, may be configured to determine whether a low speed operation of the motor part is required, and configured to perform the low speed operation of the motor part if the low speed operation of the motor part is required, and then perform a high speed operation of the motor part. During the low speed operation, a loss operation, in which an amount of heat radiation of the motor part is increased, may be performed by increasing an electric current being supplied to the motor part, and during the high speed operation, an efficiency operation in which an operating efficiency of the motor part is enhanced may be performed.

The control part, if the temperature of the oil sensed by the sensor part is below a first reference temperature, may determine that the low speed operation of the motor part is required.

When a current limit circle, a load curve and a maximum torque curve per unit current with respect to the motor part are represented on a d and q axes current coordinate plane, a magnetic flux current command and a torque current command of a point satisfying the load curve among current values belonging to the current limit circle may be provided to the motor part, thereby performing the loss operation.

As described above, when the operation of the compressor is required, the compressor is driven at a low speed, and thus the oil foam is reduced when compared to driving the compressor at a high speed, while preventing the oil of a foam state from being discharged all together.

In addition, since the heating operation is performed during the low speed operation to evaporate the refrigerant dissolving in the oil of the compressor, the compressor enters the normal operation faster than a case in which the wiring is heated in a stop state of the compressor.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 7A is a graph showing the change in operation speed of a compressor in accordance with a conventional compressor controlling method.

DETAILED DESCRIPTION

Figure 1:
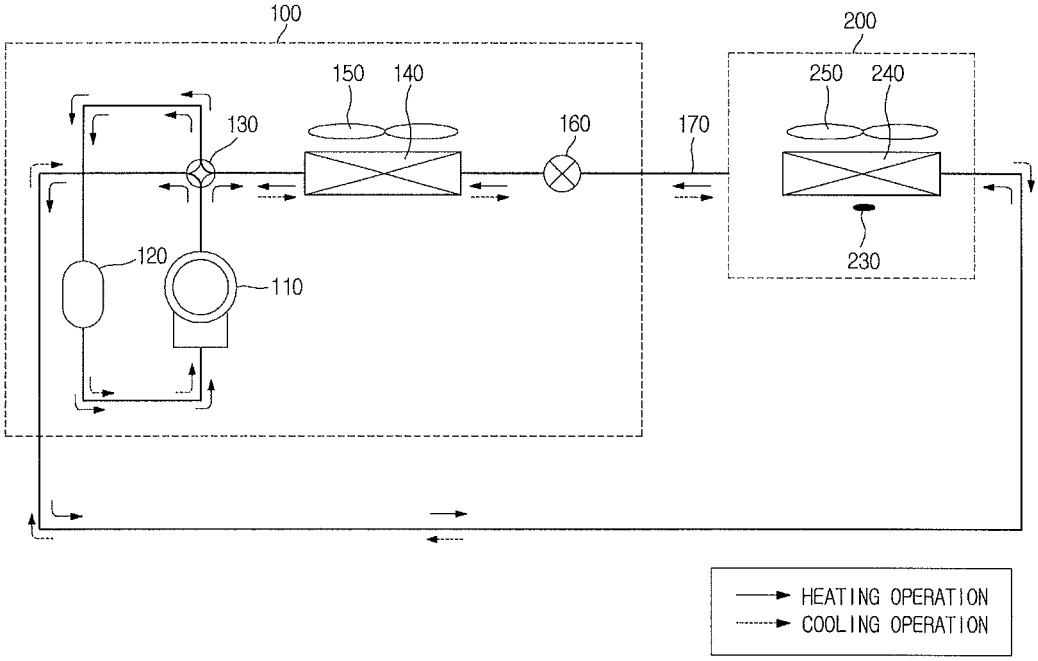
FIG. 1 is a drawing illustrating the configuration of an air conditioner including a compressor in accordance with an embodiment of the present disclosure.

Reference will now be made in detail to the embodiments of the present disclosure, examples of which are illustrated in the accompanying drawings, wherein like reference numerals refer to like elements throughout.

FIG. 1 is a drawing illustrating the configuration of an air conditioner including a compressor in accordance with an embodiment of the present disclosure.

Referring to FIG. 1, an air conditioner includes an outdoor unit 100 and an indoor unit 200.

The indoor unit 100 includes a compressor 110, a four-way valve 130, an outdoor heat exchanger 140, an outdoor fan 150, an electronic expansion valve (EEV) 160, and an accumulator 120. The indoor unit 200 includes an indoor heat exchanger 240, an indoor fan 250 and an indoor temperature sensor 230.

The compressor 110 is an inverter type compressor configured to compress refrigerant, which is drawn in a gas state having a low temperature and low pressure, and discharge refrigerant in a gas state having a high temperature and high pressure. The detailed description of the compressor 110 will be made later with reference to FIGS. 2A to 3.

The four-way valve 130, depending on whether the operation mode selected by a user is a cooling operation mode or a heating operation mode, performs an ON/OFF switching such that the flow of refrigerant is changed. In detail, the four-way valve 130 has two independent paths configured to transfer the high temperature and high pressure gas refrigerant being discharged from the compressor 110 to the indoor heat exchanger 240 during a heating operation, and transfer the high temperature-high pressure gas refrigerant to the outdoor heat exchanger 140 during a cooling operation.

The outdoor heat exchanger 140 exchanges heat with surrounding air in response to the change of enthalpy of refrigerant. In detail, the outdoor heat exchanger 140, during a cooling operation mode, serves as a condenser configured to condense the high temperature and high pressure gas refrigerant into normal temperature and high pressure liquid refrigerant. In contrast, the outdoor heat exchanger 140, during a heating operation mode, serves as an evaporator configured to evaporate the low temperature and low pressure liquid refrigerant to gas refrigerant.

The outdoor fan 150 serves to promote the heat exchange between the refrigerant flowing in the outdoor heat exchanger 140 and air, thereby enhancing the heat exchange efficiency of the outdoor unit 100.

The electronic expansion valve 160 is installed between the outdoor heat exchanger 140 and the indoor heat exchanger 240 to expand a normal temperature and high pressure liquid refrigerant, which is condensed and introduced from one of the outdoor heat exchanger 140 and the indoor heat exchanger 240, into a two phase refrigerant having a liquid phase and a gas phase mixed, thereby decompressing the refrigerant.

The accumulator 120 is installed at an inlet side of the compressor 110 such that a refrigerant, which is drawn to the compressor 110, is converted into a refrigerant of a complete gas state.

The indoor heat exchanger 240 exchanges heat with surrounding air in response to the change of enthalpy of the refrigerant. In this case, the indoor heat exchanger 240 performs a heat exchanger in the opposite manner to the outdoor heat exchanger 140. In detail, the indoor heat exchanger 240, during a cooling operation mode, serves as an evaporator, and during a heating operation mode, serves as a condenser.

The indoor fan 250 promotes the heat exchange between the refrigerant flowing in the indoor heat exchanger 240 and air. In addition, the indoor fan 250 generates cool air or hot air that is required indoors.

The indoor temperature sensor 230 senses the temperature of air of the indoor in which the indoor unit 200 is installed.

In the air conditioner described above, the flow of refrigerant is changed by the four-way valve 130 switched depending on whether an operation mode selected by a user is a cooling operation mode or a heating operation mode.

For example, during the heating operation, the four-way valve 130 is switched on, and thus the refrigerant forms a refrigeration cycle shown as a solid line arrow on FIG. 1. That is, a refrigeration cycle is formed to circulate the refrigerant in the sequence of the compressor 110, the four way valve 130, the indoor heat exchanger 240, the electronic expansion valve 160, the outdoor heat exchanger 140, the four way valve 130, the accumulator 120, and the compressor 110.

Meanwhile, during the cool operation, the four-way valve 130 is switched off, and the refrigerant forms a refrigeration cycle shown as a dotted line arrow on FIG. 1. That is, a refrigeration cycle is formed to circulate the refrigerant in the sequence of the compressor 110, the four way valve 130, the outdoor heat exchanger 140, the electronic expansion valve 160, the indoor heat exchanger 240, the four way valve 130, the accumulator 120, and the compressor 110.

Although not shown on the drawing, one of the outdoor unit 100 and the indoor unit 200 may include an input part to receive a command by a user, a control part to control each component of the air conditioner according to the operation mode selected by a user, and a communication part to transmit and receive data with an external device, such as a mobile device or a server.

Although the air conditioner shown on FIG. 1 is illustrated as having one outdoor unit 100 and one indoor unit 200, each of the indoor unit 100 and the outdoor unit 200 may be provided in at least one unit thereof.

Hereinafter, the configuration of the compressor 110 in accordance with the embodiment of the present disclosure will be described with reference to FIGS. 2A to 2C.

Figure 2A:
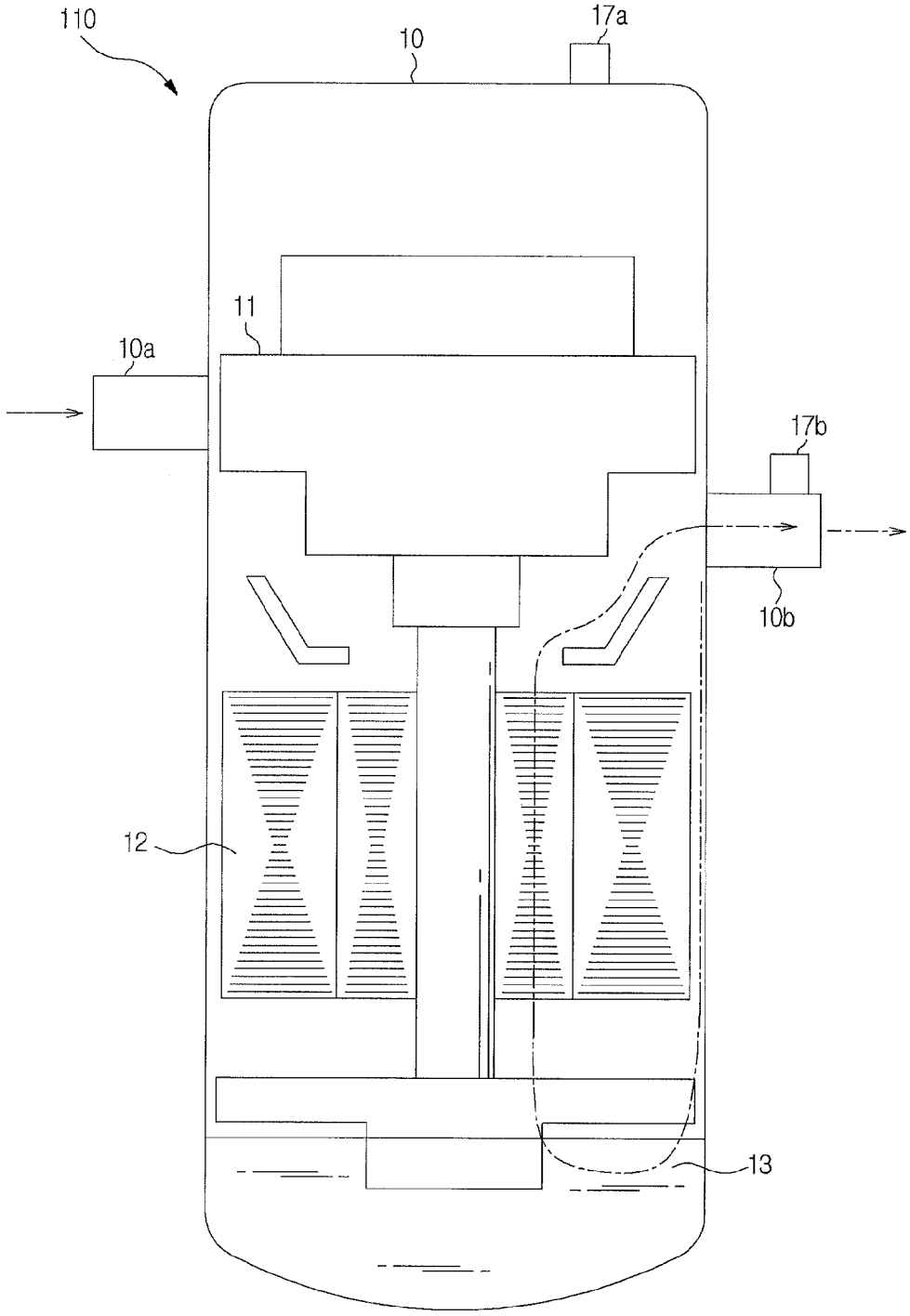
FIGS. 2A to 2C are drawings illustrating the inner configuration of the compressor in accordance with the embodiment of the present disclosure, illustrating various examples of the position of a sensor part.
Figure 2B:
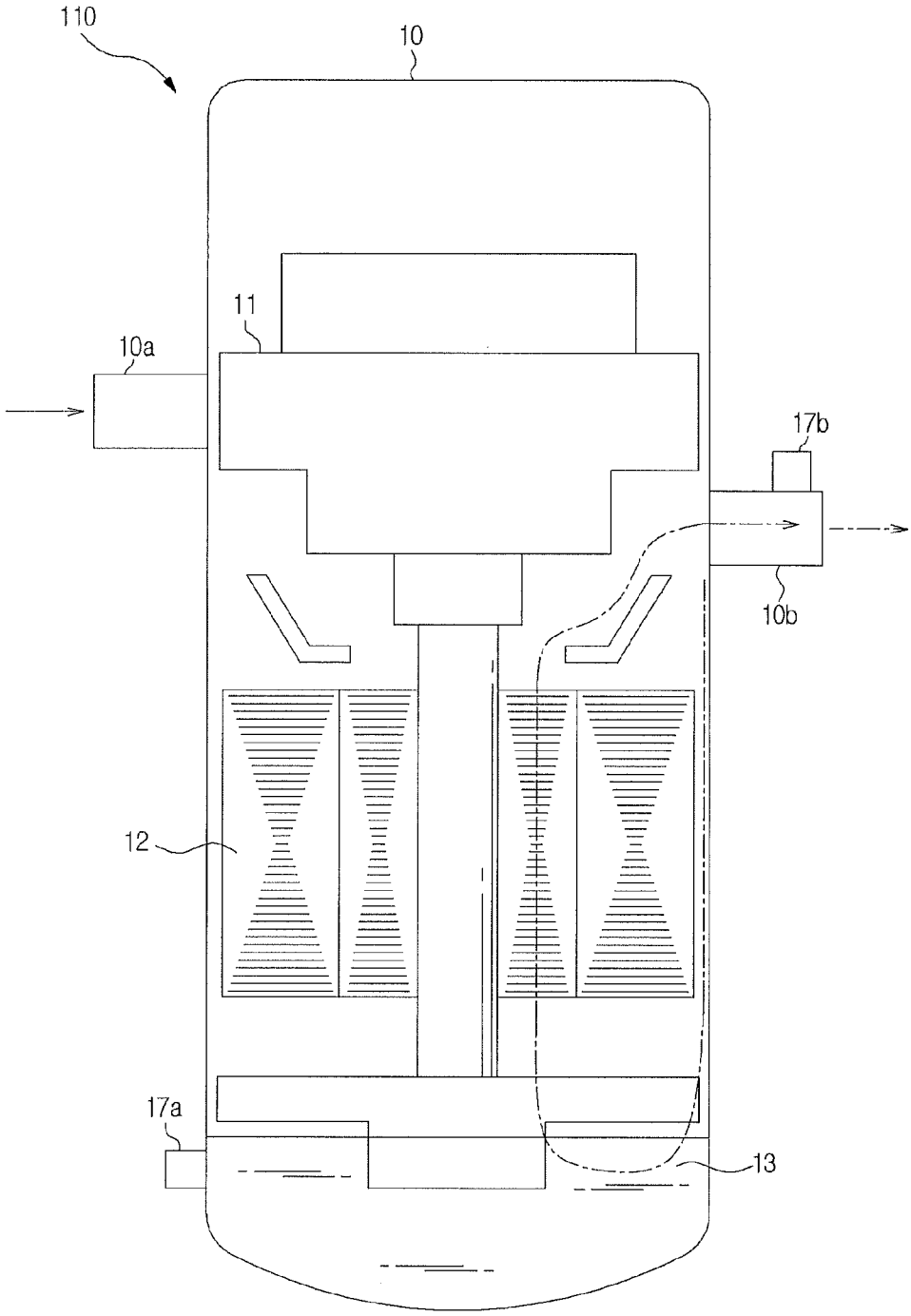
Figure 2C:
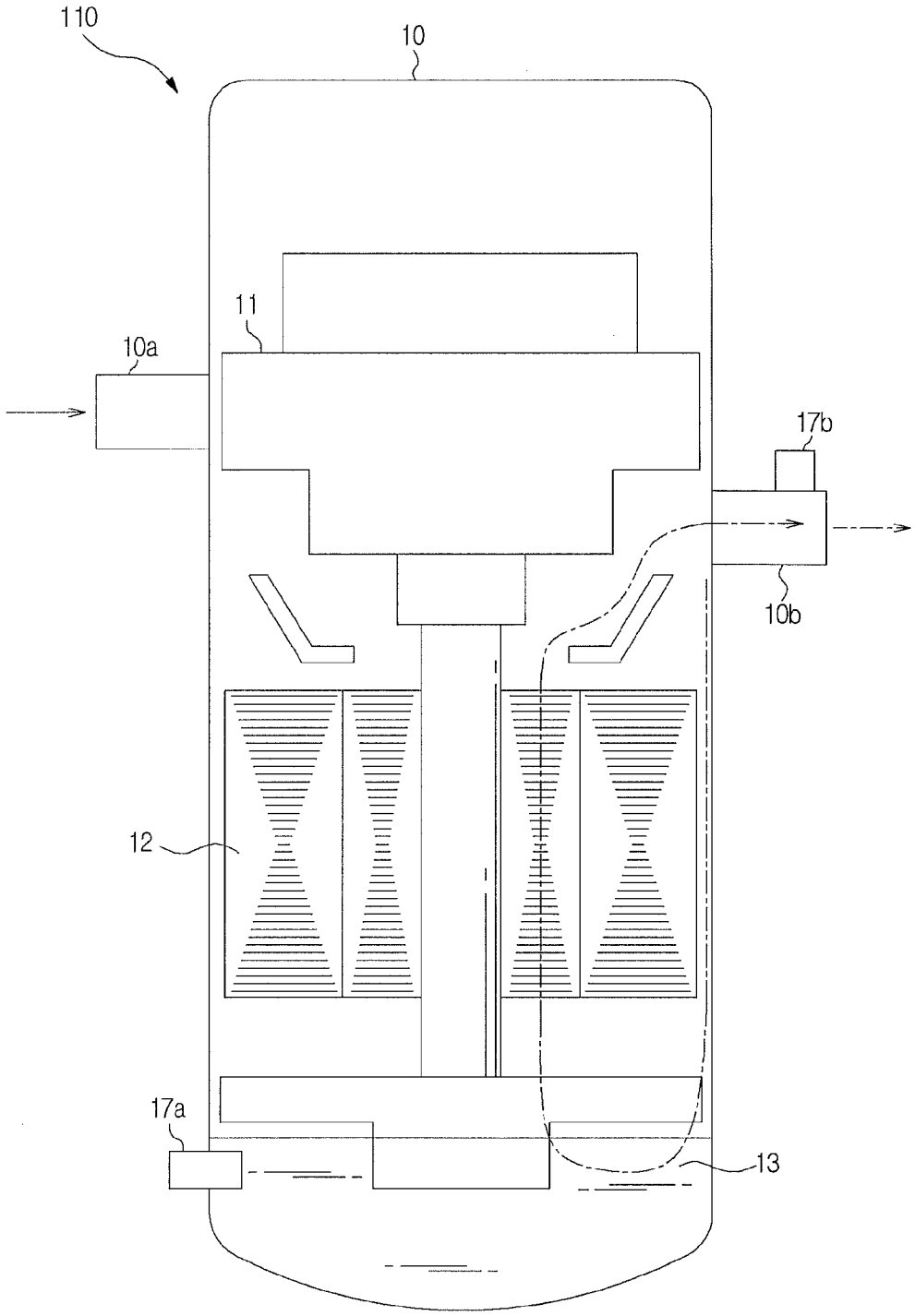

Referring to FIGS. 2A to 2C, the compressor 110 includes a casing 10, a sensor part (17 in FIG. 3), a compressor part 11, and a motor part 12.

The casing 10 accommodates refrigerant and oil while forming an accommodation space at an inside thereof. An inlet port 10*a* and an outlet port 10*b* are formed through the outer surface of the casing 10. The accumulator 120 is connected to the inlet port 10*a* to draw the gas state refrigerant, and the four-way valve 130 is installed at the outlet port 10*b* to change the flow of the refrigerant. A heater (not shown) may be provided at an outside of the casing 10 to heat the casing 10. For example, the heater may be provided at a lower side of the casing 10. The heater serves to heat the casing 10 when the operation of the compressor 110 stops in a power-on state of the air conditioner.

The compressor 11 is installed at an inside the casing 10 to compress the refrigerant.

The motor part 12 is installed at an inside the casing 10 to provide the compressor 11 with a driving force. The detailed description of the motor part 12 will be made later with reference to FIG. 3.

The sensor part 17 includes a first temperature sensor 17*a* to sense the temperature of oil 13 stored in the casing 10, and a second temperature sensor 17*b* to sense the temperature of refrigerant being discharged through the outlet port 10*b*.

The first temperature sensor 17*a* may indirectly sense the temperature of the oil 13 while being installed at an outside the casing 10, or may directly sense the temperature of the oil 13 while being penetratively installed through a lower portion of the casing 10.

In one example shown in FIG. 2A, the first temperature sensor 17*a* may be installed at a upper portion of the outside of the casing 10. In this case, the temperature sensed by the first temperature sensor 17*a* is not the temperature of the oil 13, but the temperature of the casing 10. Accordingly, the compressor 110 may include a compensation part (29 in FIG. 3) to compensate the temperature sensed by the first temperature sensor 17*a* to a value approximate to the actual temperature of the oil 13.

In another example show in FIG. 2B, the first temperature sensor 17*a* may be installed at a lower portion of the outer side of the casing 10. If the first temperature sensor 17*a* is installed at the lower portion of the outer side of the casing 10, the distance between the first temperature sensor 17*a* and the oil 13 is small, so the change in temperature of the oil 13 is rapidly sensed. Even in this case, the temperature sensed by the first temperature sensor 17*a* is not the temperature of the oil 13, but the temperature of the casing 10. Accordingly, the compressor 110 may include a compensation part (29 in FIG. 3) to compensate the temperature sensed by the first temperature sensor 17*a* to a value approximate to the actual temperature of the oil 13.

In another example shown in FIG. 2C, the first temperature sensor 17*a* may be penetratively installed from the lower portion of the outside of the casing 10 to the lower portion of the inside of the casing 10. In this case, the first temperature sensor 17*a* makes contact with the oil 13, so the temperature sensed by the first temperature sensor 17*a* is the actual temperature of the oil 13. Accordingly, the compensation part may be omitted.

For the convenience sake of description, the following description will be made in relation to the first temperature sensor 17*a* being installed at the upper portion of the outer side of the casing 10 as shown in FIG. 2A.

Figure 3:
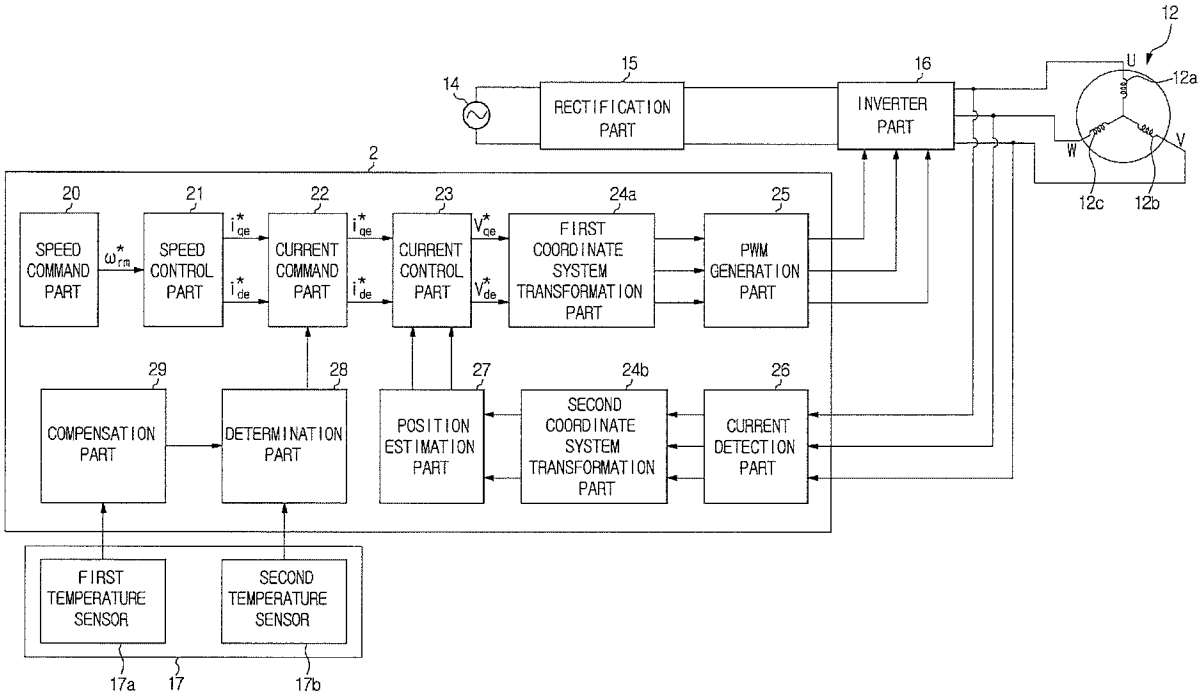
FIG. 3 is a drawing illustrating a control configuration of the compressor in accordance with the embodiment of the present disclosure.

FIG. 3 is a drawing illustrating a control configuration of the compressor in accordance with the embodiment of the present disclosure.

Referring to FIG. 3, the compressor 110 in accordance with the embodiment of the present disclosure includes the motor part 12, a commercial power source 14, a rectifying part 15, an inverter part 16, a sensor part 17 and a control part 2.

The motor part 12 includes a stator (not shown) and a rotor (not shown). The stator is provided with three wirings of U, V, W wirings 12*a*, 12*b* and 12*c*. Each of the wiring 12*a*, 12*b* and 12*c* includes copper or aluminum. The rotor includes a permanent magnet, and is disposed so as to enable rotation with respect to the stator. If a voltage is applied to each of the wirings 12*a*, 12*b* and 12*c*, the wirings 12*a*, 12*b* and 12*c* each generate a magnetic field, and the rotor is rotated by the magnetic field.

Meanwhile, the wirings 12*a*, 12*b* and 12*c* of the stator each generate heat in addition to the magnetic field. The amount of heat being generated from each of the wirings 12*a*, 12*ba* and 12*c* is as follows.

$$P_{loss}=i^2R \quad \text{[Equation 1]}$$

In the equation 1, i represents the current flowing through the wirings 12*a*, 12*b* and 12*c* of the stator, and R represents the resistance of each of the wirings 12*a*, 12*b* and 12*c*.

As shown in Equation 1, if a current is supplied to the wirings 12*a*, 12*b* and 12*c* of the stator, heat $P_{loss}$ is generated as much as the square of the current. Accordingly, if the current being supplied to the wirings 12*a*, 12*b* and 12*c* is increased, the heat generated from each wiring is increased, and the compressor 110 is heated by use of the heat.

The commercial power source 14 may include a single-phase power source or a three-phase power source supplied from a commercial power source system.

The rectifying part 15 rectifiers the alternating current power being output from the commercial power source 14 to a direct current power. In one example, the rectifying part 15 includes four diodes (not shown) provided in the form of a two-phase bridge, and a smoothing capacitor (not shown). Through the rectifying part 15, the electric wave is rectified. In another example, the rectifying part 15 may be provided with a dual voltage circuit, through which a half wave rectification is performed.

The inverter part 16 converts the direct current voltage of the smoothing capacitor to a voltage having a frequency that drives the motor part 12. The inverter part 16 may include six switching devices (not shown) connected in the form of a three-phase bridge. The switching device is switched on and off according to the signal being output from a pulse width modulation (PWM) generation part 25, and converts a voltage being applied from the rectifying part 15 to a three-phase voltage and applies the converted voltage to the motor part 12.

The sensor part 17, as described above, includes the first temperature sensor 17*a* to sense the temperature of the casing 10, and the second temperature sensor 17*b* to sense the temperature of the refrigerant being discharged through the outlet port 10*b*.

The control part 2 compares the temperature of the oil 13 with a predetermined reference temperature, and depending on the result of comparison, performs a heating operation during a low speed operation, or performs a normal operation.

In detail, the control part 2, if the temperature of the oil 13 is below a first reference temperature, performs a heating operation while driving the motor part 12 at a low speed. The control part 2, during the heating operation, performs a loss operation, in which the amount of heat radiation of the wirings 12*a*, 12*b* and 12*c* of the motor part 12 is increased, by increasing the electric current being supplied to the motor part 12. As the heating operation is performed during a low speed driving, if determined that the heating operation is not required, the control part 2 performs a normal operation in which the motor part 12 is driven at a high speed. During the normal operation, the motor part 12 performs an efficiency operation in which the operating efficiency of the motor part 12 is enhanced.

To this end, the control part 2 includes a compensation part 29, a determination part 28, a speed command part 20, a speed control part 21, a current command part 22, a current control part 23, a first coordinate system transformation part 24*a*, the pulse width modulation (PWM) generation part 25, a current detection part 26, a second coordinate system transformation part 24*b*, and a position estimation part 27.

The compensation part 29 compensates the temperature of the casing 10 sensed by the first temperature sensor 17*a* to a value approximate to the actual temperature of the oil 13, and provides the determination part 28 with the value. For example, the compensation part 29 may determine a compensation value in consideration of the thermal conductivity of the material forming the casing 10 and the error range of measurement of the first temperature sensor 17*a*. Hereinafter, the temperature of the oil 13 having been subject to the compensation by the compensation part 29 will be referred to as 'temperature of the oil' for the convenience sake of description.

The determination part 28 compares the temperature of the oil 13 supplied from the compensation part 29 with a first reference temperature, determines whether a low speed operation and a heating operation are required, and provides a result of the determination to the current command part 22, which is to be described later. The heating operation represents increasing the amount of heat radiation of the wirings 12*a*, 12*b* and 12*c* by increasing the size of the current being supplied to the wirings 12*a*, 12*b* and 12*c* of the motor part 12.

In detail, if the temperature of the oil 13 is equal to or higher than the first reference temperature, the determination part 28 determines that the low speed operation and the heating operation are not required. If determined that the low speed operation and the heating operation are not required, the normal operation is performed. During the normal operation, a maximum efficiency operation is performed on the compressor 110. The detailed description of the maximum efficiency operation will be made later with reference to FIG. 4.

If the temperature of the oil 13 is below the first reference temperature, the determination part 28 determines that the low speed operation and the heating operation are required. If determined that the low speed operation is required, the heating operation is performed during the low speed operation. During the heating operation, a maximum loss operation is performed on the compressor 110. The detailed description of the maximum loss operation will be made later with reference to FIG. 4.

The speed command part 20, if the compressor 110 starts running, outputs a speed command $\omega_{rm}$* that is to be applied to the motor part 12. In detail, in a case that the compressor 110 starts running as a user inputs an operation command, the speed command part 20 outputs a speed command $\omega_{rm}$* to drive the motor part 12 at a low speed. The speed command $\omega_{rm}$* output from the speed command part 20 is provided to the speed control part 21. '*' shown on FIG. 3 represents a 'command'.

The speed control part 21 outputs a current command corresponding to the speed command being output from the speed command part 20. That is, the speed control part 21 outputs a magnetic flux current command $i_{de}$* and a torque current command $i_{qe}$* on a synchronous rotation coordinate system. The synchronous rotation coordinate system represents a coordinate system formed by a d-axis and a q-axis. The d-axis represents an axis in the direction of the magnetic flux of a rotor, and the q-axis represents an axis deflected from the d-axis by 90 degrees in the rotation direction of the rotor.

The current command part 22, depending on the result of determination by the determination part 28, may output the magnetic flux current command $i_{de}$* and the torque current command $i_{qe}$*, which are input from the speed control part 21, to the current control part 23, or may output a new magnetic flux current command and a torque current command to the current control part 23.

In detail, if the determination part 28 determines that the heating operation is not required, the current command part 22 may output the magnetic flux current command $i_{de}$* and the torque current command $i_{qe}$*, which are input from the speed control part 21. In this case, the magnetic flux current command and the torque current command that are output from the current command part 22 represent a current command for a maximum efficiency operation.

If the determination part 28 determines that the heating operation is required, the current command part 22 may output a new magnetic flux current command and a new torque current command having values larger than the magnetic flux current command and the torque current command, which are received from the speed control part 21, respectively. In this case, the magnetic flux current command and the torque current command that are output from the current command part 22 represent a current command for a maximum loss operation. The current control for the maximum loss operation will be described in detail with reference to FIG. 4.

Figure 4:
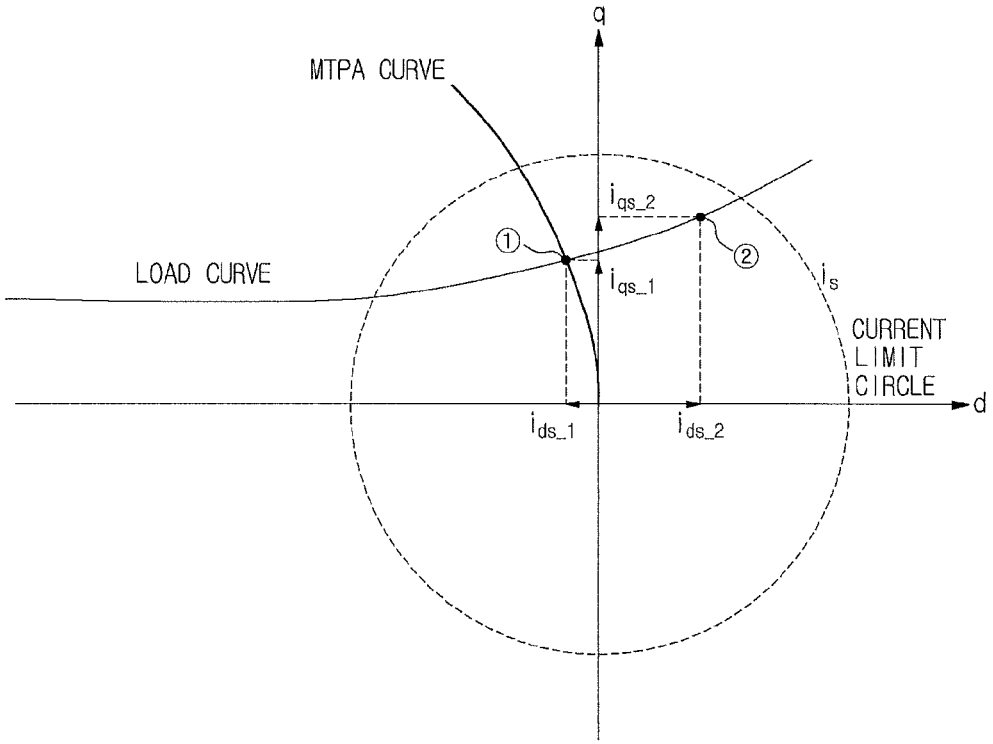
FIG. 4 is a drawing used to explain an operation performed by the compressor in accordance with the embodiment of the present disclosure, illustrating a current limit circle, a load curve and a MTPA curve on the d and q axes current coordinate plane.

FIG. 4 is a drawing used to explain an operation performed by the compressor in accordance with the embodiment of the present disclosure, illustrating a current limit circle, a load curve and a MTPA curve on the d and q axes current coordinate plane.

On FIG. 4, the current limit circle represents a range of a magnetic flux current command (d-axes current command) and a torque current command (q-axes current command) that are controllable by a maximum stator current $i_s$ that is set to the motor part 12. That is, the current command needs to be provided with a value within the current limit circle, so as to enable a current control.

The load curve represents a load curve of the motor part 12 of the compressor 110.

The MTPA (Maximum Torque per Ampere) curve represents a combination of the d-axis current and the q-axis current that generate a maximum torque per unit current. If the heating operation is not required as the temperature of the oil 13 is below the first reference temperature, the current command part 22 outputs a magnetic flux current command $i_{ds_i}$ and a torque current command $i_{qs_i}$ that correspond to a point ① satisfying the load curve and the MTPA curve among current values belonging to the current limit circle, so that a maximum efficiency operation is performed.

If the heating operation is required as the temperature of the oil 13 is equal to or higher than the first reference temperature, the current command part 22 outputs a magnetic flux current command and a torque current command having values larger than the point ① among the current values belonging to the current limit circle. For example, the current command part 22 outputs a magnetic flux current command $i_{ds_2}$ and a torque current command $i_{qs_2}$ that corresponds to a point ② on the load curve, so that the maximum loss operation is performed. That is, the current command part 22 increases the size of the current being supplied to the wirings 12*a*, 12*b* and 12*c* of the motor part 12, so that the amount of heat radiation of the wirings 12*a*, 12*b* and 12*c* of the motor part 12 is increased.

As shown in FIG. 4, the point ② is not a point satisfying the load curve and the MTPA curve. Accordingly, if a magnetic flux current and a torque current of sizes corresponding to the point ② is supplied to the motor 12, the operating efficiency of the compressor 110 may be degraded to some extent when compared to supplying the magnetic flux current and the torque current having sizes corresponding to the point ① to the motor part 12. However, the point ② is located on the load curve while existing within the current limit circle, thereby having no influence on the operation of the compressor 110.

Although the current command part 22, during the maximum loss operation, is illustrated as changing the magnetic current command and the torque current command into the point ② as an example, the present disclosure is not limited thereto. In another example, the current command part 22 may increase only the magnetic flux current command. The following description will be made in relation that the current command part 22 increases both of the magnetic flux current command and the torque current command during the heating operation.

Referring again to FIG. 3, the current control part 23 receives a magnetic flux current command $i_{de}$* and a torque current command $i_{qe}$*, which are output from the current command part 22, and outputs a magnetic flux voltage command $V_{de}$* and a torque voltage command $V_{qe}$* on a synchronous rotation coordinate system.

The first coordinate system transformation part 24*a* transforms the magnetic flux voltage command $V_{de}$* and the torque voltage command $V_{qe}$* on a synchronous rotation coordinate system to a magnetic flux voltage command and a torque voltage command on a stationary coordinate system, respectively. Thereafter, the transformed two-phase voltage command is transformed to a three-phase voltage command that is equivalent to the two-phase voltage command. The three phase voltage command is provided to the PWM generation part 25. The transformation from the synchronous rotation coordinate system to the stationary coordinate system is generally known in the art, and the detailed description thereof will be omitted.

The PWM generation part 25 outputs a current signal that is pulse width modulated based on the three-phase voltage command being output from the first coordinate system transformation part 24.

The switching device of the inverter part 16 is switched on and off according to the current signal being output from the PWM generation part 25, and thus converts a voltage being applied from the rectifying part 15 into a three-phase voltage and applies the three-phase voltage to the motor part 12.

If the three-phase voltage is applied to the wirings 12*a*, 12*b* and 12*ca* of the motor part 12, the current detection part 26 detects a current flowing through the wirings 12*a*, 12*b* and 12*c* of the motor part 12. The three-phase current being detected by the current detection part 26 is provided to the second coordinate system transformation part 24*b*.

The second coordinate system transformation part 24*b* converts the three-phase current being detected by the current detection part 26 into a two-phase current that is equivalent to the three-phase current. In this case, the two-phase current may be represented on the stationary coordinate system. Subsequently, the two-phase current on the stationary coordinate system is transformed to a two-phase current on the synchronous rotation coordinate system. The transformation from the stationary coordinate system to the synchronous rotation coordinate system is generally known in the art, and the detailed description will be omitted.

The position estimation part 27, based on a sensorless algorithm, estimates the position and the speed of the rotor. According to the sensorless algorithm, the position and the speed of the rotor are estimated without a position detection sensor configured to detect the position of the rotor. In order to store the sensorless algorithm, the position estimation part 27 may include a memory part (not shown).

Figure 5:
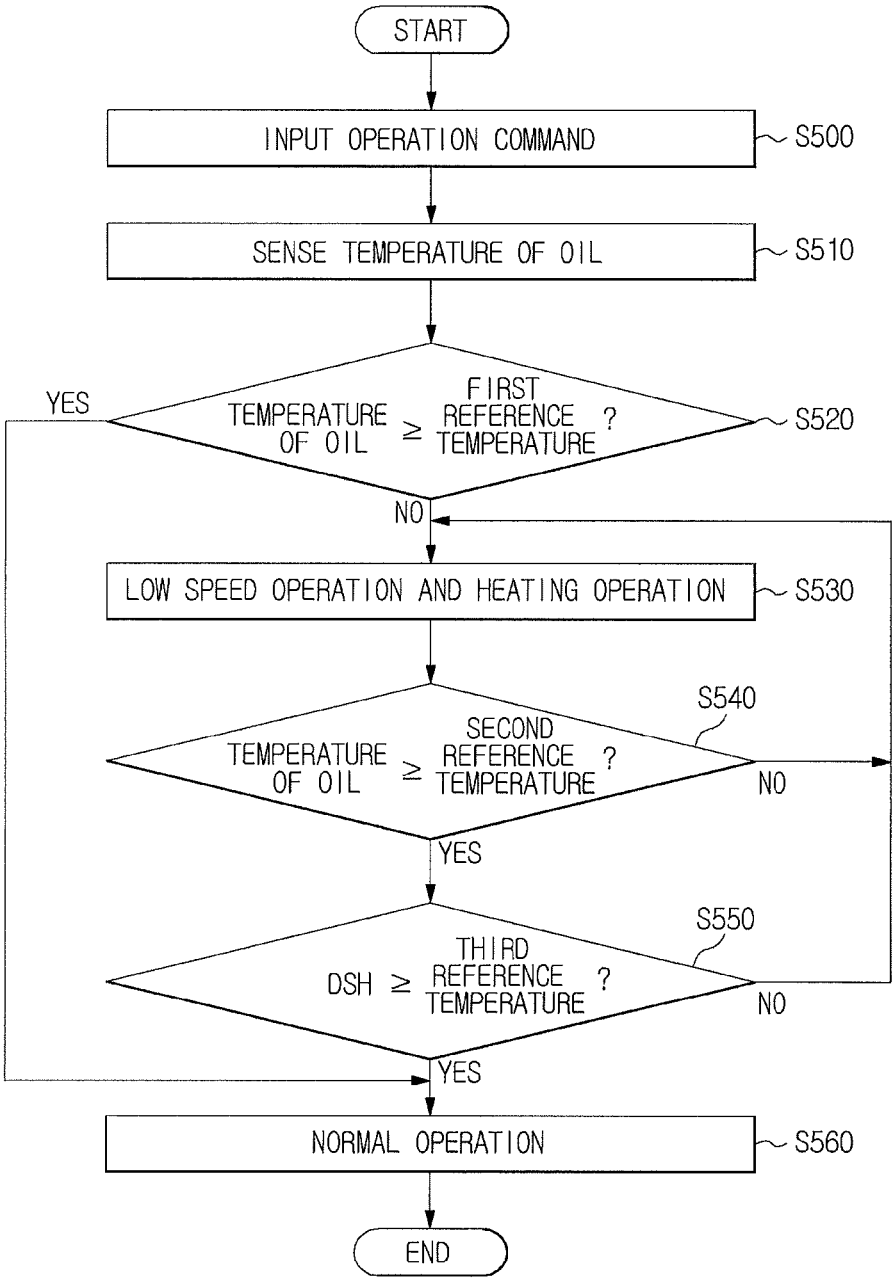
FIG. 5 is a flow chart showing a method of controlling a compressor in accordance with an embodiment of the present disclosure.

FIG. 5 is a flow chart showing a method of controlling a compressor in accordance with an embodiment of the present disclosure.

With respect to describing the control method of the compressor 110, the compressor 110 is assumed as being remaining for a long period of time at a low temperature and a power-off state.

If a user inputs an operation command S500, the temperature of the oil 13 is sensed S510. The operation S510 sensing the temperature of the oil 13 includes a process in which the first temperature sensor 17*a* senses the temperature of the casing 10, and a process in which the oil of the casing sensed by the first temperature sensor 17*a* is compensated to a value approximate to an actual temperature of the oil 13.

If the temperature of the oil 13 is sensed, whether the sensed temperature of the oil 13 is equal to or higher than a first reference temperature S520. The first reference temperature may be set in advance. For example, the first reference temperature may be set to about 50° C. to 60° C.

If determined from operation S520 that the temperature of the oil 13 is below the first reference temperature (NO from S520), the control part 2 performs a low speed operation and a heating operation S530. That is, the control part 2 may perform a heating operation while operating the motor part at a low speed. During the heating operation, the control part 2 performs a loss operation, in which the amount of heat radiation of the wirings 12*a*, 12*b*, and 12*c* of the motor part 12 is increased, by increasing the current being supplied to the motor part 12.

If the motor part 12 is driven at a low speed as the above, the refrigerant, dissolving in the oil 13 in the casing 10, is inhibited from being rapidly separated when compared to a case in which the motor part 12 is driven at a high speed, thereby reducing the oil foaming. In addition, even if the oil foaming occurs, the oil in a foam state is prevented from being discharged through the outlet port 10*b* all together.

In addition, if the heating operation is performed during a low speed operation, the refrigerant dissolving in the oil 13 at an inside the casing 10 is rapidly evaporated, and is discharged through the outlet port 10*b*, thereby compensating for the discharge speed of the refrigerant that is sluggish due to the low speed operation.

Hereinafter, the operation S530 in which the low speed operation and the heating operation are performed will be described in detail with reference to FIG. 6.

Figure 6:
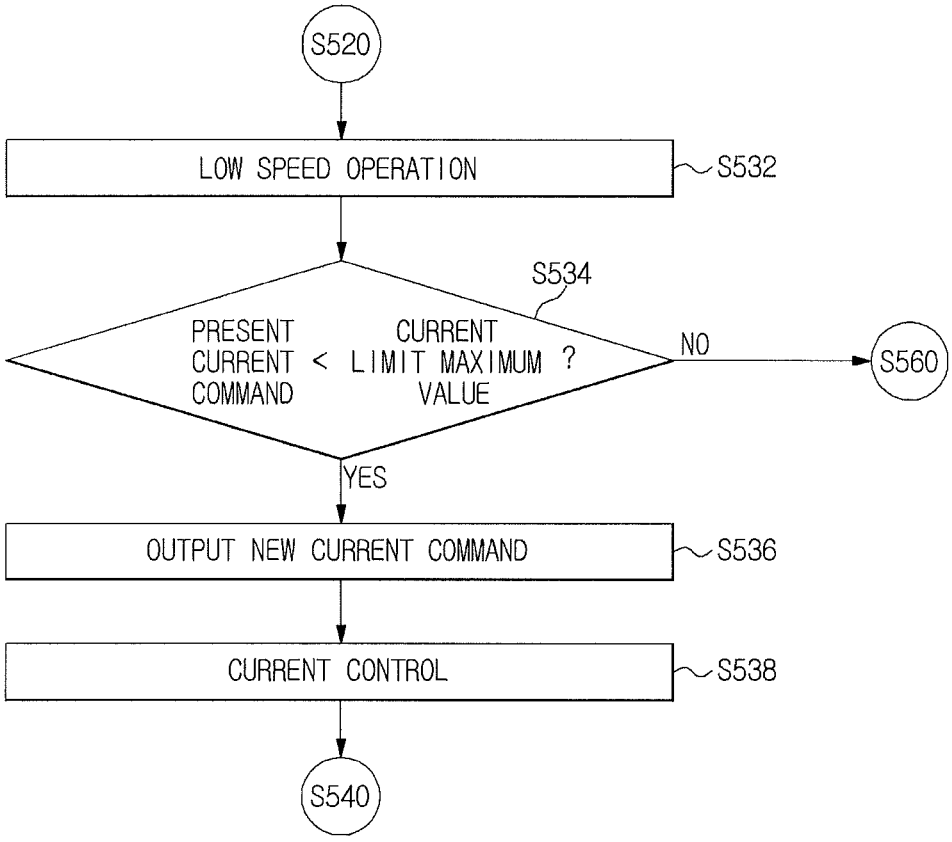
FIG. 6 is a flow chart showing operation S530 of FIG. 5 in detail.

Referring to FIG. 6, the operation S530 includes a process of driving the motor part 12 at a low speed S532, a process of determining whether the present current command is smaller than a current limit maximum value S534, a process of outputting a new current command having a value larger than the present current command if the present current command is smaller than the current limit maximum value S536, and a process of performing a current control according to the current command being output S538.

Operation S532 in which the motor part 12 is driven at a low speed includes a process in which the speed command part 20 outputs a speed command, a process in which the speed control part 21 outputs a current command corresponding to the speed command being output, a process in which the current command part 22 provides the current control part 23 with the current command being output, a process in which the current control part 23 outputs a two-phase voltage command corresponding to the current command being received, a process in which the first coordinate transformation part 24*a* outputs a three-phase voltage command corresponding to the two-phase voltage command, a process in which the PWM generation part 25 outputs a current signal, which is pulse-width modulated based on the three-phase voltage command, to the inverter part 16, and a process in which the inverter 16 is switched on and off according to the current signal such that a voltage being received from the rectifying part 15 is converted into a three-phase voltage and the three-phase voltage is applied to the motor part 12.

Operation S534 of determining whether the present current command is smaller than a current limit maximum value is performed by the current command part 22. The current limit maximum value represents a boundary of a current limit circle. Accordingly, determining whether the present current command is smaller than the current limit maximum value represents determining whether the present current command exists at an inside the current limit circle.

If determined from operation S534 that the present current command is not smaller than the current limit maximum value, that is, the present current command is located at the boundary of the current limit circle, it is determined that the size of the current command is not increased any more, and thus a normal operation is performed S560.

If determined from operation S534, the present current command is smaller than the current limit maximum value, that is, the present current command is located at an inside the current limit circle, the current command part 22 outputs a new current command having a value larger than the present current command S536. For example, when the present current command corresponds to the point ① shown on FIG. 4, the current command part 22 outputs a magnetic flux current command and a torque current command that correspond to the point ② shown on FIG. 4. The point ② represents a point, which is located on the load curve while belonging to the inside the predetermined current limit circle.

If the new current command is output as in operation S536, the current control is performed according to the current command being output S538. Operation S538 of performing the current control is achieved by the cooperation among the current control part 23, the first coordinate system transformation part 24*a*, and the PWM generation part 25.

Referring again to FIG. 5, after the low speed operation and the heating operation are performed in operation S530, the determination part 28 determines whether the temperature of the oil 13 exceeds a second reference temperature S540, and whether the discharge superheat (DSH) of the compressor 110 exceeds a third reference temperature S550.

The second reference temperature may be equal to the first reference temperature, or may be different from the first reference temperature. That is, the second reference temperature may be lower or higher than the first reference temperature. The discharge superheat (DSH) represents a value of the discharge temperature of the compressor 110 minus a high-pressure saturated temperature. The discharge temperature of the compressor 110 is determined as a higher value between the temperature sensed by the first temperature sensor 17*a* and the temperature sensed by the second temperature sensor 17*b*.

If determined from operation S540 and S550 that the temperature of the oil 13 is equal to or higher than the second reference temperature and the DSH is equal to or higher than the third reference temperature, most of the refrigerant dissolved in the oil 13 in the casing 10 is considered as being discharged almost. The third reference temperature is set in advance. For example, the third reference temperature may be set to be equal to or higher than 10° C.

If the temperature of the oil 13 is equal to or higher than the second reference temperature and the DSH is equal to or higher than the third reference temperature, all the refrigerant dissolved in the oil 13 in the casing 10 is considered as being evaporated. Accordingly, the control part 2 performs a normal operation S560. That is, the control part 2 performs a high speed operation by increasing the speed of the motor part 12 to reach an indoor temperature that is set by a user. During a normal operation, the maximum efficiency operation is performed to enhance the efficiency of the motor part 12.

In accordance with the embodiment of the present disclosure, during the heating operation, the maximum loss operation is performed by supplying a magnetic flux current and a torque current that correspond to the point ② shown on FIG. 4. When the maximum loss operation is performed, if the temperature of the oil 13 and the DSH reach to the second reference temperature and the third reference temperature, respectively, and the heating is determined as not needed, a magnetic flux current and a torque current that correspond to the point ① shown on FIG. 4 are supplied to the motor part 12, so that the maximum efficiency operation is performed.

As described above, if the heating operation is performed during the low speed operation, the refrigerant dissolved in the oil 13 in the compressor 110 is evaporated, so that the waiting time taken until a heating is completed is reduced and the compressor 110 rapidly resumes the normal operation when compared to heating the wiring in a stop state of the compressor 110. Since the waiting time taken until the heating is completed is reduced, the satisfaction to a user and the reliability of the compressor are improved. The detailed description on the above will be made with reference to FIGS. 7A and 7B.

Figure 7B:
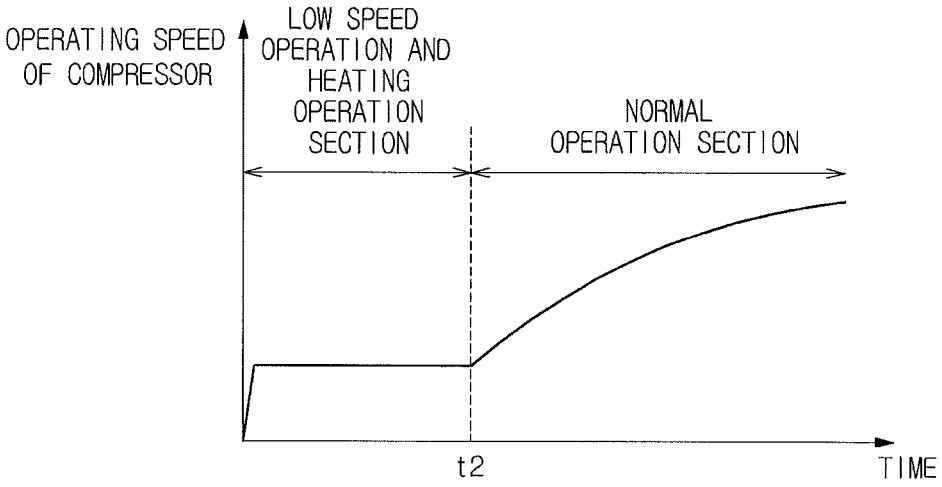
FIG. 7B is a graph showing the change in operation speed of the compressor in accordance with the embodiment of the present disclosure.

FIG. 7A is a graph showing the change in operation speed of a compressor in accordance with a conventional compressor controlling method. FIG. 7B is a graph showing the change in operation speed of a compressor in accordance with the embodiment of the present disclosure.

Referring to FIG. 7A, in the conventional compressor controlling method, if an operation command is input, the casing of the compressor is heated by flowing a predetermined size of current through the wiring of the motor part in a state that the compressor stops. If the temperature of the oil reaches to a predetermined temperature, the compressor is controlled to perform a normal operation. That is, the compressor is driven at a high speed so as to reach a predetermined condition that is set by a user. As for the conventional compressor controlling method, the compressor enters a waiting mode for about two or three hours until the temperature of the oil reaches to a predetermined temperature.

Referring to FIG. 7B, in the method of controlling the compressor in accordance with the embodiment of the present disclosure, if an operation command is input, the compressor 110 is heated as a heating operation is performed while the compressor 110 is being driven at a low speed. In this case, the compressor 110 is driven at a low speed, so the refrigerant dissolved in the oil 13 is slowly separated, and thus the oil foaming is reduced. Even if the oil foaming occurs, since the compressor 110 is driven at a low speed, the oil 13 in a foam state is prevented from being discharged to the outside the compressor 110 all together. In addition, the heating operation is performed during the low speed operation of the compressor 110, the refrigerant dissolved in the oil 13 is rapidly evaporated and discharged to the outside the compressor due to the heating operation. As a result, the discharge speed of the refrigerant that is sluggish due to the low speed operation is compensated, and the compressor 110 rapidly enters a normal operation. That is, as shown FIGS. 7A and 7B, t2 is shorter than t1.

Figure 8:
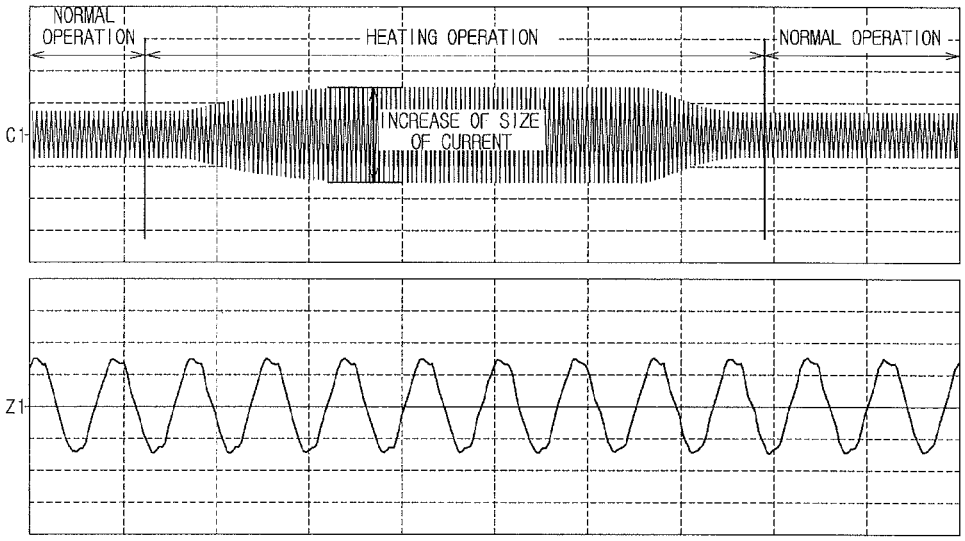
FIG. 8 is a drawing showing the change in electric current according to a heating operation when operating the compressor in accordance with the embodiment of the present disclosure.

FIG. 8 is a drawing showing the change in electric current when operating the compressor 110 in accordance with the embodiment of the present disclosure.

Referring to FIG. 8, the operation of the compressor 110 proceeds in a sequence of a normal operation, a heating operation and a normal operation, and the size of the current during the heating operation is increased when compared to the normal operation.

Hereinbefore, the compressor in accordance with one embodiment of the present disclosure and the method of controlling the compressor in accordance with one embodiment of the present disclosure have been described above. The above description has been made in relation that the temperature of the casing 10 is sensed by use of the first temperature sensor 17*a*, and the sensed temperature of the casing 10 is compensated by the compensation part 29 to a value approximate to the actual temperature of the oil 13 as an example. The following description of another embodiment of the present disclosure will be made in relation to a compressor provided with a prediction part to predict the temperature of the oil 13 while omitting the first temperature sensor 17*a* and the compensation part 29 according to the above embodiment, and a method of controlling the compressor.

Figure 9:
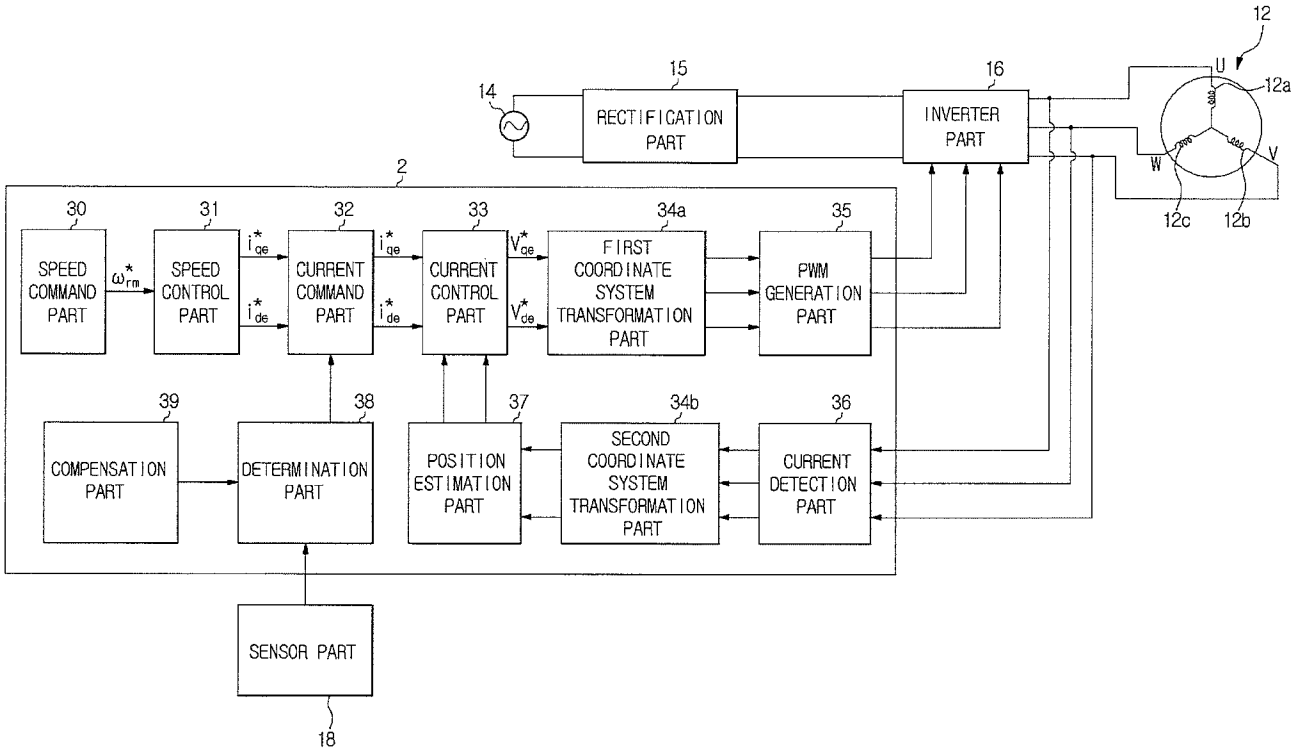
FIG. 9 is a drawing illustrating a control configuration of a compressor in accordance with another embodiment of the present disclosure.

FIG. 9 is a drawing illustrating a control configuration of a compressor in accordance with another embodiment of the present disclosure.

Referring to FIG. 9, the compressor in accordance with another embodiment of the present disclosure includes a motor part 12, a commercial power source 14, a rectifying part 15, an inverter party 16, a sensor part 18 and a control part 3.

Referring to FIG. 9, the detailed description of the elements identical to those according to the previous embodiment will be omitted, and the following description will be made in relation to the sensor part 18 and the control part 3.

Different from the sensor part 17 on FIG. 3 including the first temperature sensor 17*a* installed at the casing 10, and the second temperature sensor 17*b* installed at the outlet port 10*b*, the sensor part 18 shown on FIG. 8 includes a temperature sensor configured to sense the temperature of the refrigerant being discharged through the outlet port 10*b* while being installed at the outlet port 10*b*.

The control part 3 includes a speed command part 30, a speed control part 31, a current command part 32, a current control part 33, a first coordinate system transformation part 34*a*, a PWM generation part 35, a current detection part 36, a second coordinate system transformation part 34*b*, a position estimation part 37, a determination part 38 and a prediction part 39. Since the other elements except for the determination part 38 and the prediction part 39 are identical to those of the previous embodiment described on FIG. 3, the description of the same reference numerals will be omitted.

The predication part 39 predicts the temperature of the oil 13 based on at least one of a stop time, during which the compressor 110 stops, and an ambient temperature. To this end, the prediction part 19 may store the temperature of the oil 13 according to the surrounding temperature of the compressor 110 and the stop time during which the compressor 110 stop. The temperature of the oil according to the surrounding temperature of the compressor 110 and the stop time during which the compressor 110 stops may be experimentally determined in advance. The data is made into a table and stored in the storage part (not shown).

The determination part 38, based on the temperature of the oil predicated by the prediction part 39, determines whether to perform the heating operation. In addition, the determination part 38 may determine whether to perform a normal operation based on the temperature of the oil predicted by the prediction part 39 and the temperature of the refrigerant sensed by the sensor part 18.

Figure 10:
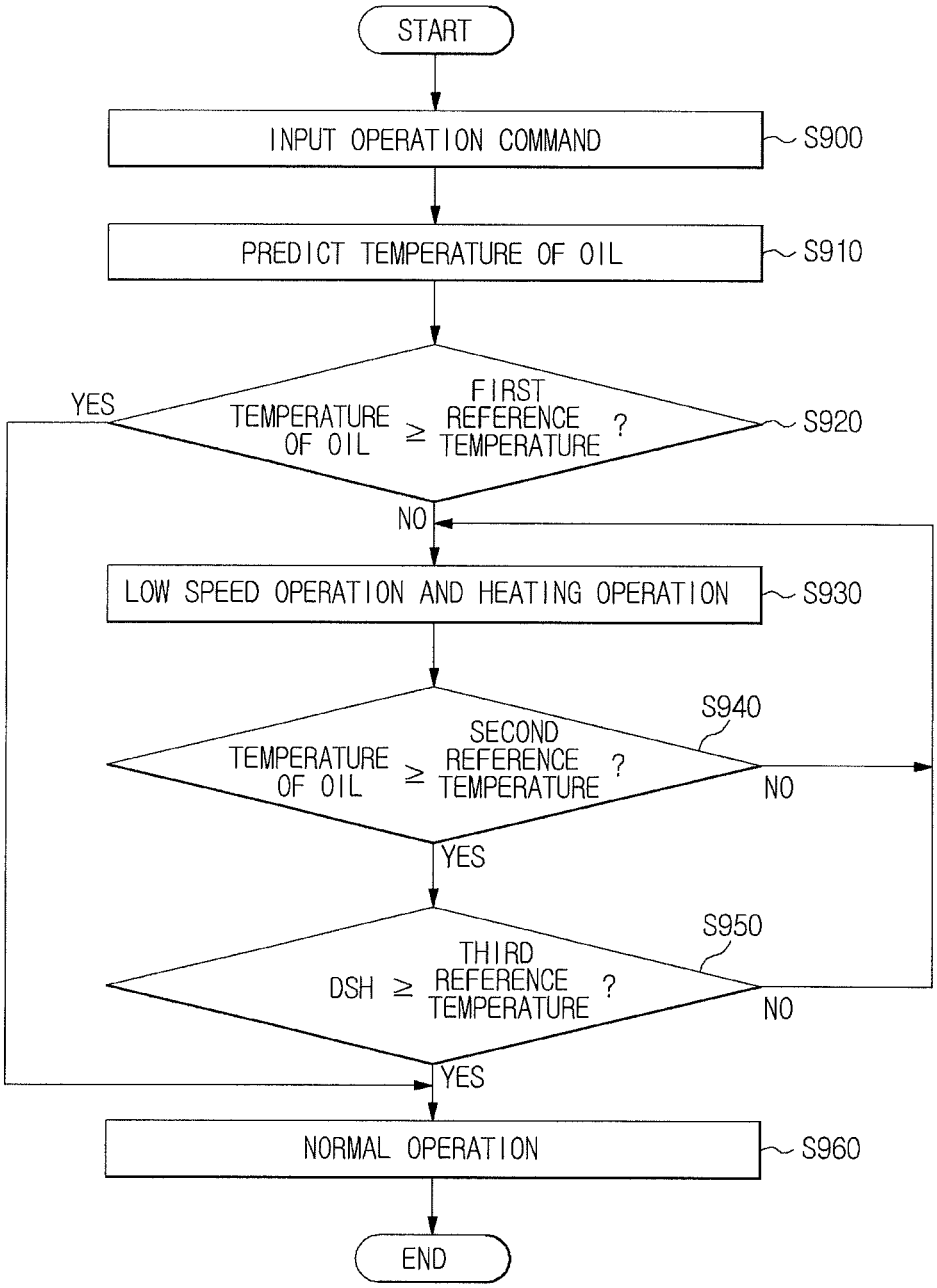
FIG. 10 is a flow chart showing a method of controlling a compressor in accordance with another embodiment of the present disclosure.

FIG. 10 is a flow chart showing a method of controlling a compressor in accordance with another embodiment of the present disclosure.

The method of controlling the compressor shown on FIG. 10 is identical to the method of controlling the compressor shown on FIG. 5 except for the operation S510 of FIG. 5, in which the temperature of the oil is a value obtained as the compensation part 29 compensates the temperature of the casing 10, which is sensed by the first temperature sensor 17*a*, to a value approximate to the actual temperature of the oil 13. Meanwhile, in operation S910 shown on FIG. 10, the temperature of the oil is a value predicted by the prediction part 39.

In addition, in operation S550 of FIG. 3, the DSH represents a value of the discharge temperature of the compressor 110 minus the high pressure saturated temperature, and the discharge temperature of the compressor 110 is determined as a higher temperature between the temperature sensed by the first temperature sensor 17*a* and the temperature sensed by the second temperature sensor 17*b*. Meanwhile, in operation S950 of FIG. 10, DSH is determined as a higher temperature between the temperature of the oil predicated by the prediction part 39 and the temperature sensed by the sensor part 18.

Some example embodiments of the present disclosure have been shown and described. With respect to some example embodiments described above, some components composing the compressor 110 can be embodied as a type of 'module'. 'Module' may refer to software components or hardware components such as Field Programmable Gate Array (FPGA) or Application Specific Integrated Circuit (ASIC), and conducts a certain function. However, the module is limited to software or hardware. The module may be composed as being provided in a storage medium that is available to be addressed, or may be composed to execute one or more processor.

Examples of the module may include an object oriented software components, class components and task components, processes, functions, attributes, procedures, subroutines, segments of a program code, drivers, firm wares, microcode, circuit, data, database, data structures, tables, arrays, and variables. The functions provided by the components and the modules are incorporated into a smaller number of components and modules, or divided among additional components and modules. In addition, the components and modules as such may execute one or more central processing units (CPUs) in a device.

Some example embodiments of the present disclosure can also be embodied as computer readable medium including computer readable codes/commands to control at least one component of the above described example embodiments. The medium is any medium that can store and/or transmit the computer readable code.

The computer readable code may be recorded on the medium as well as being transmitted through internet, and examples of the medium include read-only memory (ROM), random-access memory (RAM), compact disc (CD)-ROMs, magnetic tapes, floppy disks and optical data storage devices. The medium may be a non-transitory computer readable medium. The medium can also be distributed over network coupled computer systems so that the computer readable code is stored and executed in a distributed fashion. In addition, examples of the component to be processed may include a processor or a computer process. The element to be processed may be distributed and/or included in one device.

While example embodiments have been particularly shown and described, it will be understood by those of ordinary skill in the art that various changes in form and details may be made therein without departing from the spirit and scope of the present invention as defined by the following claims.

What is claimed is:

1. A method of controlling a compressor comprising a casing configured to accommodate refrigerant and oil while forming an accommodation space therein, a compressor part to compress refrigerant while being installed at an inside of the casing, a motor part installed at an inside of the casing to provide the compressing part with a driving force, and a sensor part having a first temperature sensor configured to sense temperature of the oil and a second temperature sensor configured to sense temperature of refrigerant being discharged from the casing, the method comprising:

inputting an operation command;

sensing temperature of the oil by the first temperature sensor;

sensing temperature of the refrigerant being discharged from the casing by the second temperature sensor;

determining a discharge temperature of the compressor, the discharge temperature of the compressor being a higher value between the temperature sensed by the first temperature sensor and the temperature sensed by the second temperature sensor;

determining a discharge superheat (DSH), the DSH representing the discharge temperature of the compressor minus a high-pressure saturated temperature;

performing a loss operation when the temperature of the oil is below a first reference temperature, the loss operation comprising increasing an amount of heat radiation of the motor part while operating the motor part at a low speed; and performing an efficiency operation when the temperature of the oil is equal to or higher than a second reference temperature and the DSH is equal to or higher than a third reference temperature.

2. The method of claim 1, wherein the first temperature sensor is configured to sense temperature of the oil while being penetratively installed from an outside of the casing to an inside of the casing so as to make contact with the oil; and the second temperature sensor is configured to sense temperature of the refrigerant being discharged from the casing while being installed at an outlet port of the casing.

3. The method of claim 1, wherein the first temperature sensor is configured to sense temperature of the oil by sensing the temperature of the casing while being installed at an outside of the casing; and the second temperature sensor is configured to sense temperature of refrigerant being discharged from the casing while being installed at an outlet side of the casing.

4. The method of claim 3, wherein the sensing of the temperature of the oil further comprises compensating the sensed temperature of the casing to a value approximate to actual temperature of the oil.

5. The method of claim 1, wherein the performing of the loss operation comprises when a present current command is within a current limit circle that represents a range of a magnetic flux current command and a torque current command that are controllable by a maximum stator current that is set to the motor part, supplying the motor part with a new current command having a value lamer than the present current command, and wherein when the current limit circle, a load curve and a maximum torque curve per unit current are represented on d and q axes current coordinate plane, the new current command comprises a magnetic flux current command and a torque current command of a point satisfying the load curve among current values belonging to the current limit circle.

6. The method of claim 3, wherein the first reference temperature is equal to the second reference temperature.

7. The method of claim 3, wherein the first reference temperature is different from the second reference temperature.

8. A compressor comprising:

a casing configured to accommodate refrigerant and oil while forming an accommodation space therein;

a compression part configured to compress the refrigerant while being installed at an inside of the casing;

a motor part configured to provide the compressor part with a driving force while being installed at an inside of the casing;

a first temperature sensor configured to sense temperature of the oil;

a second temperature sensor configured to sense temperature of refrigerant being discharged from the casing; and a control part configured to determine a discharge temperature of the compressor, the discharge temperature of the compressor being a higher value between the temperature sensed by the first temperature sensor and the temperature sensed by the second temperature sensor, to determine a discharge superheat (DSH), the DSH representing the discharge temperature of the compressor minus a high-pressure saturated temperature, to perform a loss operation when the temperature of the oil is below a first reference temperature by increasing an amount of heat radiation of the motor part while operating the motor part at a low speed, and to perform an efficiency operation when the temperature of the oil is equal to or higher than a second reference temperature and the DSH is equal to or higher than a third reference temperature.

9. The compressor of claim 8, wherein the first temperature sensor is configured to sense temperature of the oil while being penetratively installed from an outside of the casing to an inside of the casing so as to make contact with the oil; and the second temperature sensor is configured to sense temperature of the refrigerant being discharged from the casing while being installed at an outlet port of the casing.

10. The compressor of claim 8, wherein the first temperature sensor is configured to sense temperature of the oil by sensing the temperature of the casing while being installed at an outside of the casing; and the second temperature sensor is configured to sense temperature of refrigerant being discharged from the casing while being installed at the outlet port of the casing.

11. The compressor of claim 10, further comprising a compensation part configured to compensate the temperature of the casing sensed by the first temperature sensor to a value approximate to actual temperature of the oil.

12. The compressor of claim 8, wherein the control part is configured to perform the loss operation by supplying the motor part with a new current command having a value larger than a present current command when the present current command is within a current limit circle that represents a range of a magnetic flux current command and a torque current command that are controllable by a maximum stator current that is set to the motor part, and wherein when the current limit circle, a load curve and a maximum torque curve per unit current are represented on a d-q axes current coordinate plane, the new current command comprises a magnetic flux current command and a torque current command of a point satisfying the load curve among current values belonging to the current limit circle.

13. The compressor of claim 9, wherein the first reference temperature is equal to the second reference temperature.

14. The compressor of claim 9, wherein the first reference temperature is different from the second reference temperature.

* * * * *